US006026666A

United States Patent [19]

Zimmermann et al.

[11] Patent Number: 6,026,666

[45] Date of Patent: Feb. 22, 2000

[54] METHOD FOR MANUFACTURING INTERNALLY GEARED PARTS

[75] Inventors: Willi Zimmermann, St. Augustin; Bernd Stein, Bonn; Jurgen Zimmermann, Troisdorf, all of Germany

[73] Assignee: Dynamit Nobel Aktiengesellschaft, Troisdorf, Germany

[21] Appl. No.: 08/875,215

[22] PCT Filed: Dec. 22, 1995

[86] PCT No.: PCT/EP95/05105

§ 371 Date: Nov. 17, 1997

§ 102(e) Date: Nov. 17, 1997

[87] PCT Pub. No.: WO96/20050

PCT Pub. Date: Jul. 4, 1996

[30] Foreign Application Priority Data

Dec. 28, 1994 [DE] Germany ..... 44 46 919

[51] Int. Cl.[7] ..... B21H 5/02

[52] U.S. Cl. ..... 72/85; 72/108

[58] Field of Search ..... 72/83, 84, 85, 72/108, 110, 466.8, 479; 279/133

[56] References Cited

U.S. PATENT DOCUMENTS 1,665,286 4/1928 Stroh et al. ..... 72/108

2,220,757 11/1940 Engle et al. ..... 72/466.8

3,535,910 10/1970 Connolly ..... 72/479

FOREIGN PATENT DOCUMENTS 58-51038 3/1983 Japan ..... 72/85

1750796 7/1992 Russian Federation ..... 72/85

2153278 8/1985 United Kingdom ..... 72/85

*Primary Examiner*—Lowell A. Larson

*Attorney, Agent, or Firm*—Antonelli, Terry, Stout & Kraus, LLP

[57] ABSTRACT

A flow-turning process for manufacturing internally geared parts, including a press mandrel (10) comprising a mandrel (1) on which is fitted a forming tool (2) and one or more pressure rollers (3). A workpiece (4) is held between the forming tool (2) or press mandrel (10) and press rollers (3) and undergoes plastic deformation under the force exerted by the press rollers (3). The forming tool comprises chromium- and molybdenum-containing materials and is tempered and surface-hardened, and the distance between the forming tool (2) and the mounting of the press mandrel (10) in the machine is sufficient to permit a degree of deviation ($\alpha$) by the forming tool (2) relative to the machine axis (5).

14 Claims, 4 Drawing Sheets

METHOD FOR MANUFACTURING INTERNALLY GEARED PARTS

BACKGROUND OF THE INVENTION

The invention relates to a method for manufacturing parts with internal teeth.

DE-A1-24 20 014 describes a cylindrical flow turning method according to the species in which a tubular workpiece is subjected to a rotating extrusion process. Plastic deformation and/or a pointwise softening of the material takes place. This method is basically different from rolling, hammering, or deep drawing, since in this case only work hardening of the material takes place.

In the flow turning method described, the workpiece is located on a rotatably driven pressure mandrel, with one or more pressure rolls abutting the workpiece during a lengthwise movement. Flow shaping of the metal takes place between the pressure mandrel and/or a shaping tool and the pressure roll and/or pressure rolls, with the wall thickness of the workpiece being reduced and its length being increased.

SUMMARY OF THE INVENTION

The goal of the invention is to improve a flow turning method sufficiently to guarantee mass production.

This goal is achieved by making the distance of the shaping tool from the point at which the pressure mandrel is mounted in the machine so great that the shaping tool can undergo a certain degree of deflection relative to the machine axis.

This guarantees that the shaping tool can center itself by deflection of the mandrel under the pressure of the pressure roll as it engages the circumference uniformly. The automatic centering of the mandrel (and hence of the shaping tool) results in reliable manufacture without constant tool breakage caused by stresses imposed by the outer-roller pressure.

The shaping tool according to the invention consists of materials containing chromium and molybdenum (for example according to DIN 1.2343, 1.2344, and 1.2606) and is quenched and tempered as well as surface-hardened. Preferably, it is then polished. As a result of these measures, the shaping tool is extremely durable and suitable for continuous use.

The distance of the shaping tool from the mounting location of the mandrel is preferably 200 mm or more, preferably 500 mm. This dimension of course depends on the stability and size of the machine. In any event, assurance must be provided that the shaping tool can undergo a certain degree of deflection.

The pressure rolls are preferably made of HSS steel or hard metal. In addition, the run-in angle of the pressure roll or pressure rolls in a preferred embodiment is between 5 and 45°, the run-out angle is between 0 and 20°, and the outer roll radius is between 0.5 and 25 mm.

Another feature according to the invention provides that the workpiece is pushed onto the shaping tool as a pre-turned or pre-forged pot-shaped blank. As a result, the workpiece is firmly anchored to the shaping tool.

In order for the pressure rolls to engage the workpiece better, a constriction is advantageously provided on the outer face of the workpiece, the depth of said constriction being 0.2–0.6×S where S is the thickness of the wall of the workpiece. Advantageously, the constriction blends with the outer circumferential surface of the workpiece at a maximum angle $\delta$ of 45°.

In one preferred version, flow turning can also be performed by the opposed turning method. A tailstock guided in the machine is placed so that it adjoins the shaping tool, so that the mandrel, shaping tool, and tailstock form a unit. The workpiece is then clamped as a pot-shaped blank between the shaping tool and the mandrel.

In another preferred embodiment, to produce parts with double-sided internal teeth, a combination of the synchronous turning method and the opposed turning method is employed, with a double-sided pot-shaped blank being located between the two shaping tools as a workpiece, a pressure roll adjacent to the tailstock in the opposed turning method is advanced from the end of the blank toward the center and a pressure roll adjacent to the mandrel is advanced from the middle of the blank in the direction of the mandrel in the synchronous turning method.

Advantageously, the double-sided pot-shaped workpiece, as a blank, has a constriction on one side directed toward the center, said constriction making a transition to the outer circumferential surface of the workpiece at a maximum angle of 20° and having a depth of 0.2–0.6×S, where S is the thickness of the wall of the workpiece.

BRIEF DESCRIPTION OF THE DRAWINGS

Further features of the invention will follow from the figures described below.

DETAILED DESCRIPTION OF THE PREFERRED EMBODIMENTS

Figure 1:
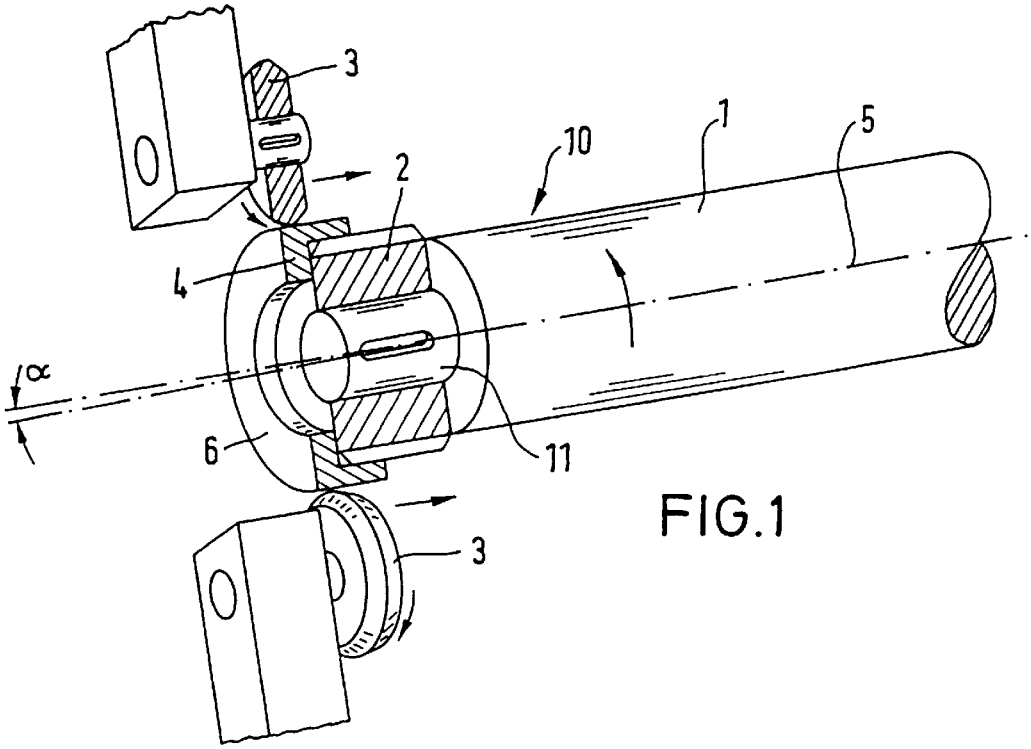
FIG. 1 shows a pressure mandrel with workpiece mounted and pressure rolls applied in the synchronous turning method.

FIG. 1 shows schematically a part of a pressure mandrel 10 that consists of a mandrel 1 with a shaping tool 2 mounted at the end. The mounting of pressure mandrel 10 in a machine is not shown. Shaping tool 2 is nonrotatably mounted on an endwise extension 11 of mandrel 1.

Figure 5:
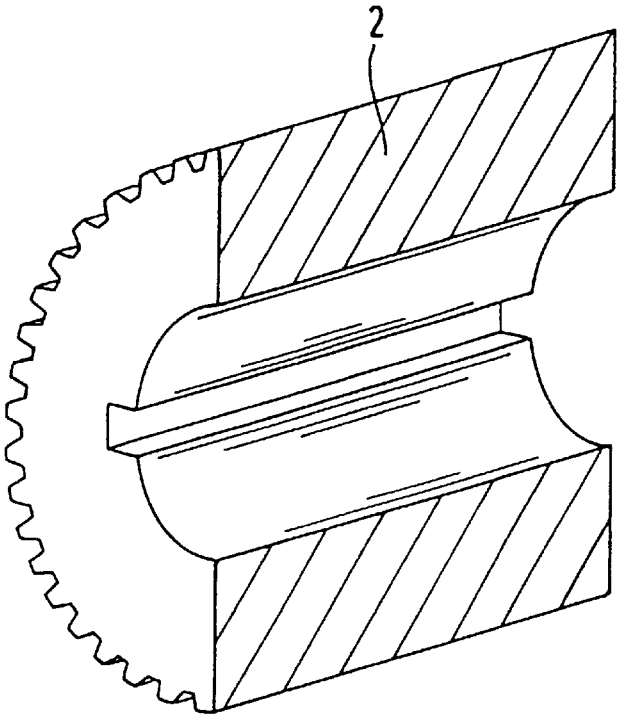
FIG. 5 shows a shaping tool in section.

FIG. 5 shows an embodiment of a shaping tool 2 in section. Lengthwise teeth, grooves, or channels are located on the surface of shaping tool 2, and represent the negative of the teeth to be produced.

A pot-shaped workpiece 4 is pushed onto shaping tool 2 (see FIG. 1). Pressure rolls 3 engage workpiece 4 externally, with flow shaping of the metal of workpiece 4 taking place under the influence of the force of pressure rolls 3. The wall thickness of the workpiece is reduced and its length is simultaneously increased. The synchronous turning method is shown here.

According to the invention, the distance of shaping tool 2 from the mounting location of pressure mandrel 10 in the machine, not shown, is made sufficiently long that shaping tool 2 can undergo a certain degree of deflection $\alpha$ relative to machine axis 5. As a result, shaping tool 2 can center itself between pressure rolls 3. The distance of shaping tool 2 from the mounting location should for this reason be 200 mm or more and preferably 500 mm. To make shaping tool 2 more durable, it is manufactured according the invention from materials that contain chromium and molybdenum and is quenched and tempered as well as surface-hardened.

Figure 2:
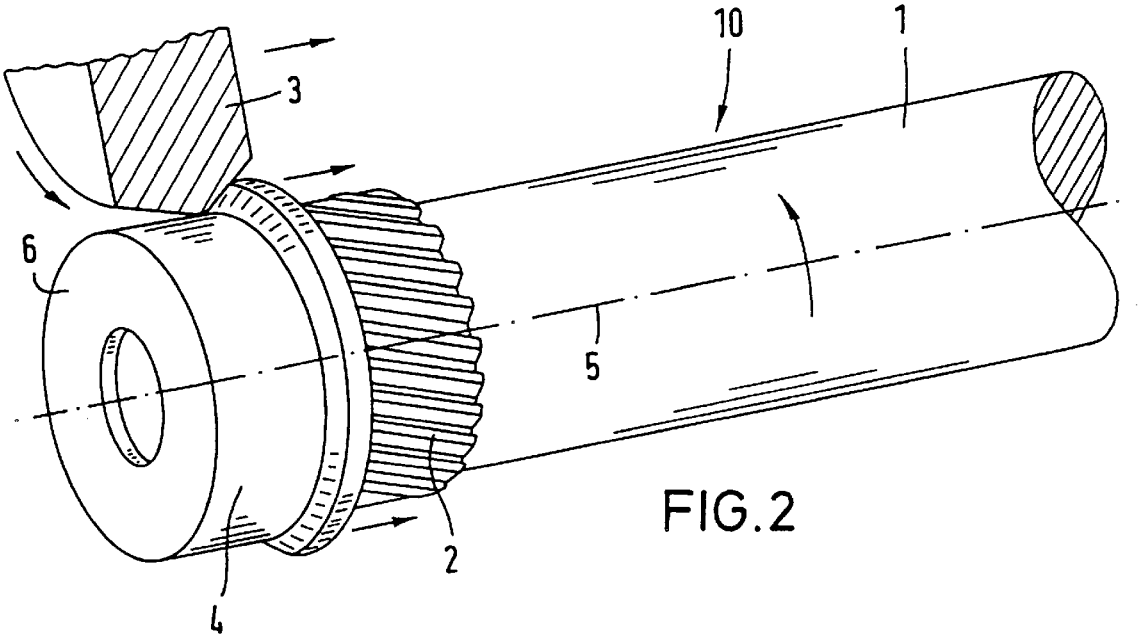
FIG. 2 shows a pressure mandrel with a helical tooth shaping tool.

FIG. 2 shows one embodiment of a pressure mandrel 10 with a helical tooth shaping tool 2 and a workpiece 4 mounted in position, said workpiece being pressed directly by a pressure roll 3 against shaping tool 2. During the shaping of parts with helical teeth, shaping tool 2 in particular is subjected to stress by the axially flowing material until the teeth break. By a corresponding choice of shaping parameters such as pressure roll feed, degree of reduction, roll geometry, and rotational speed of the machine, the tendency of the material to twist as it is shaped is utilized. As a result, the strain on shaping tool 2 is relieved and a longer service life results.

Shaping the workpiece using the flow-turning method results in a significant hardening of the material. This hardening can be influenced by a suitable choice of the degree of shaping and tool geometry. As a result, subsequent quenching and tempering and hardening of parts with internal teeth become unnecessary. Work hardening as well as possible surface hardening by known nitriding methods guarantee the desired hardness and wear resistance of the parts.

Figure 3:
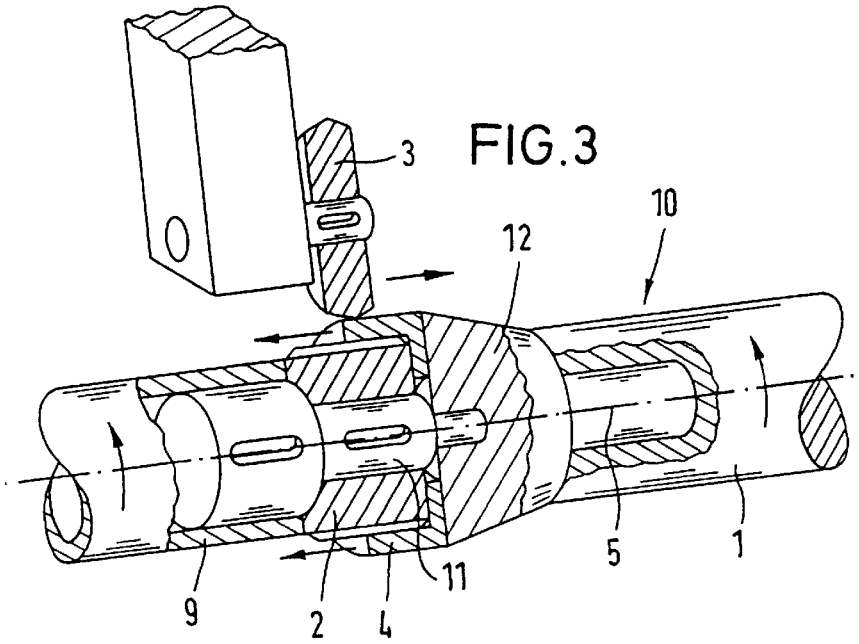
FIG. 3 shows an arrangement for flow turning using the opposed turning method.

FIG. 3 shows flow turning using the opposed turning method. In this case, a tailstock 9 guided in the machine is located adjacent to shaping tool 2, with mandrel 1, shaping tool 2, and tailstock 9 forming a unit. Workpiece 4 is clamped as a pot-shaped blank between shaping tool 2 and mandrel 1 or a holding element 12. The pressure roll or pressure rolls 3 engage the end of workpiece 4 facing tail stock 9 and move from there in the direction of mandrel 1.

Figure 4:
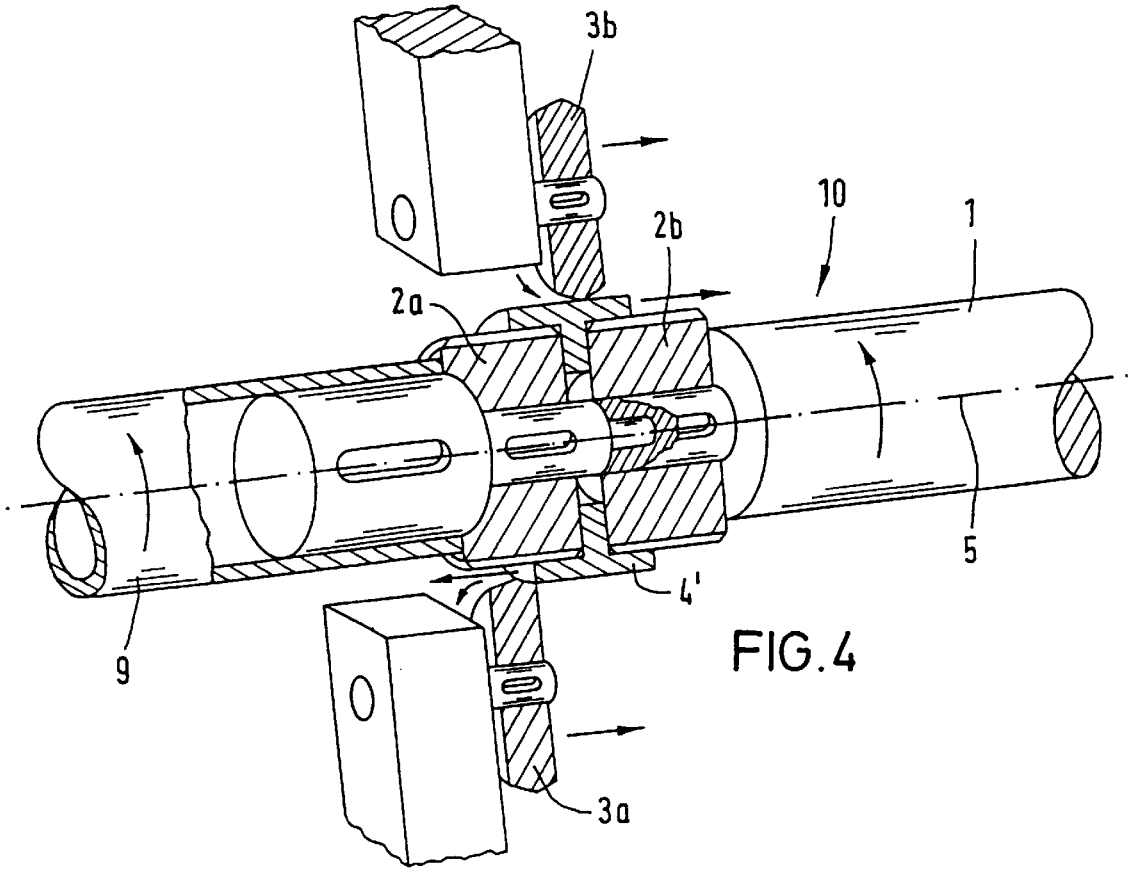
FIG. 4 is an arrangement for flow turning of a workpiece with double-sided teeth.

FIG. 4 shows the manufacture of a part with double-sided internal teeth using a combination of the synchronous turning method and the opposed turning method. Two shaping tools 2*a*, 2*b* are located between a tailstock 9 and a mandrel 1, with a double-sided pot-shaped workpiece 4' being located between shaping tools 2*a*, 2*b*. This workpiece 4' is described in greater detail in FIG. 8. Flow turning using the synchronous turning method is performed by a pressure roll 3*b* that is moved from the middle of workpiece 4' toward mandrel 1. The opposed turning method uses a pressure roll 3*a* adjacent to tailstock 9 that is moved from the end of workpiece 4' toward the middle.

Figure 6:
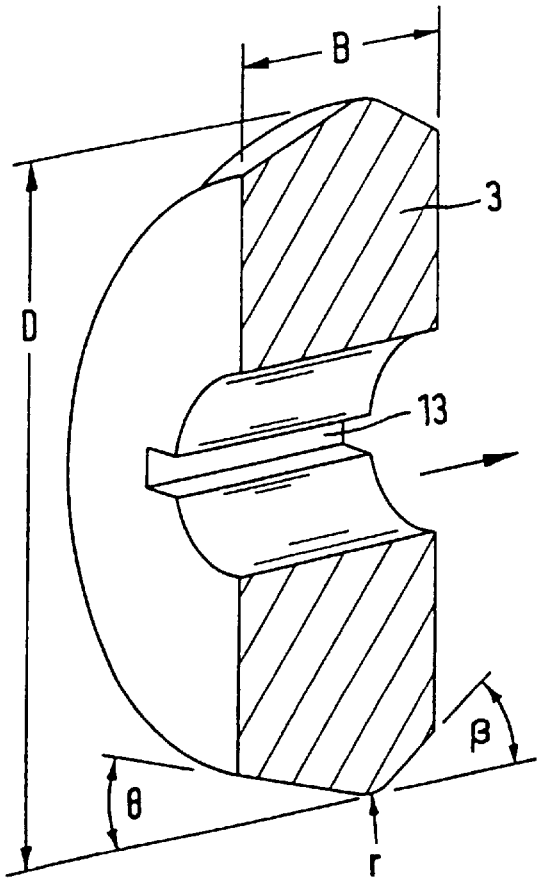
FIG. 6 shows a pressure roll in section.

FIG. 6 shows a section through a pressure roll 3. This roll has an inner bore with a groove 13 to anchor it. According to the invention, pressure rolls 3 are advantageously made of HSS steel or a hard metal. The run-in angle β of pressure roll 3 is advantageously between 5 and 45°, the run-out angle θ is between 0 and 20°, and the outer roll radius r is between 0.5 and 25 mm. Roll thickness B is advantageously between 60 and 260 mm and roll width D is between 20 and 90 mm.

As already mentioned, workpiece 4, 4' advantageously is pushed onto shaping tool 2 as a preturned or preforged blank.

Figure 7:
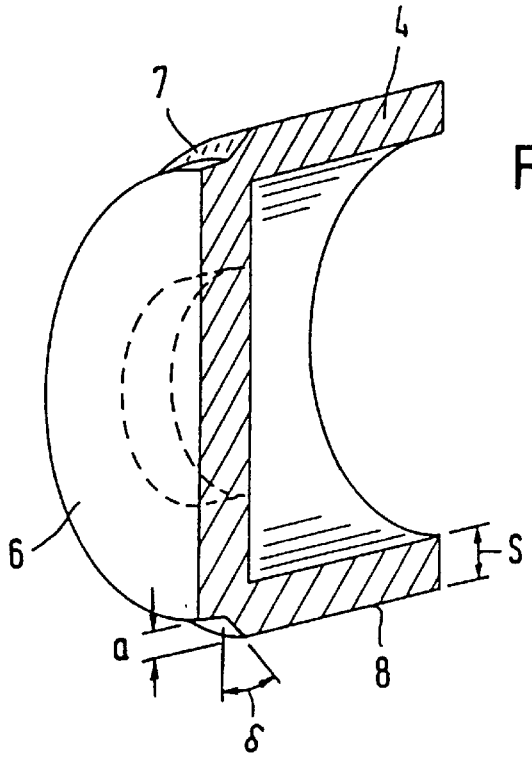
FIG. 7 shows a pot-shaped workpiece as a blank in section.

FIG. 7 shows a workpiece 4 to be used advantageously in the synchronous turning method. FIG. 1 shows a corresponding arrangement. Pot-shaped workpiece 4 has a constriction 7 on outer end 6, the depth of said constriction being a=0.2–0.6×S, where S is the thickness of the wall of workpiece 4 as a blank. Constriction 7 makes a transition at a maximum angle δ of 45° to the outer circumferential surface of workpiece 4. This constriction 7 permits a better engagement of pressure rolls 3.

Figure 8:
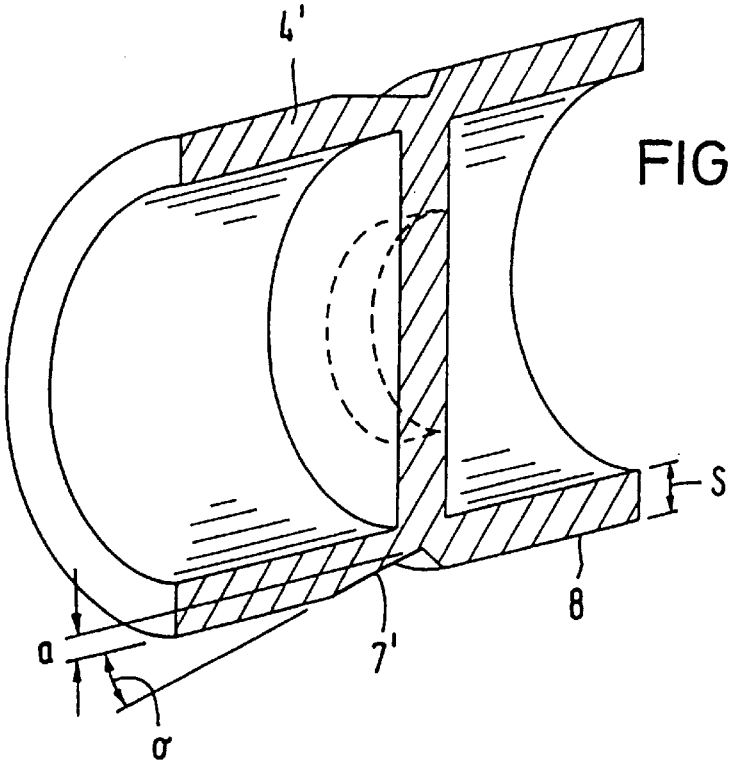
FIG. 8 shows a double pot-shaped workpiece as a blank in section.

In FIG. 8 a double pot-shaped workpiece 4' is shown in section as a blank. This workpiece 4' is used in the device described in FIG. 4. Workpiece 4' has a constriction 7' on one side directed toward the middle, said constriction making a transition with the outer circumferential surface B of workpiece 4' with a maximum angle σ of 20° and a depth a of 0.2 to 0.6×S where S is the thickness of the wall of workpiece 4' as a blank. This constriction 7' is provided for better engagement of pressure rolls 3*b* in FIG. 4.

We claim:

1. Flow turning method for manufacturing parts with internal teeth, comprising: providing a pressure mandrel mounted at a mounting location of the mandrel provided at a first end of the mandrel in a machine for rotation of the mandrel about a longitudinally extending machine axis; providing a shaping tool mounted on or adjacent a second end of the mandrel opposite the first end; providing one or more pressure rolls spaced from the circumference of the shaping tool; providing a workpiece between the shaping tool and the one or more pressure rolls; rotating the mandrel and applying force to the workpiece by the one or more pressure rolls, whereby the workpiece is plastically deformed by the application of force, wherein a distance of the shaping tool from the mounting location of the pressure mandrel is large enough that the shaping tool can undergo a degree of deflection (α) with respect to the machine axis so that the shaping tool can center itself automatically under the pressure of the one or more pressure rolls applied uniformly around the circumference of the shaping tool by deflection of the mandrel.

2. Flow turning method according to claim 1, characterized in that the shaping tool comprises materials containing chromium and molybdenum, is quenched and tempered and surface hardened.

3. Flow turning method according to claims 1, characterized in that the distance of the shaping tool from the mounting location of the pressure mandrel is 200 mm or more.

4. Flow turning method according to claim 1, characterized in that the one or more pressure rolls are made from HSS steel.

5. Flow turning method according to claim 1, characterized in that a run-in angle (β) of the one or more pressure rolls is between 5 and 45°, a run-out angle (θ) is between 0 and 20°, and an outer roll radius (r) is between 0.5 and 25 mm.

6. Flow turning method according to claim 1, characterized in that the workpiece is pushed onto the shaping tool as a preturned or preforged pot-shaped blank.

7. Flow turning method according to claim 6, characterized in that a constriction is provided on an outer end of the workpiece, a depth (a) of the constriction being 0.2–0.6×S, where S is a thickness of a wall of the workpiece.

8. Flow turning method according to claim 7, characterized in that the constriction makes a transition to an outer circumferential surface of the workpiece at a maximum angle (δ) of 45°.

9. Flow turning method according to claim 1, characterized in that flow turning is performed using an opposed turning method, with a tailstock guided in the machine being located adjacent to the shaping tool and mandrel, the shaping tool and tailstock forming a unit, and the workpiece being clamped as a pot-shaped blank between the shaping tool and the mandrel.

10. Flow turning method according to claim 1, characterized in that a combination of a synchronous turning method and an opposed turning method is used to manufacture parts with internal double-sided teeth, wherein two shaping tools are located between a tailstock and the mandrel, a double-sided pot-shaped workpiece is located between the two shaping tools, a pressure roll adjacent to the tailstock is advanced in the opposed turning method from the end of the workpiece toward the middle and a pressure roll adjacent to the mandrel is advanced in the synchronous turning method from the middle of the workpiece toward the mandrel.

11. Flow turning method according to claim 10, characterized in that the double-sided pot-shaped workpiece as a blank, has a constriction that is directed toward the middle on one side, the constriction making a transition to an outer circumferential surface of the workpiece at a maximum angle $\sigma$ of 20° and having a depth (a) of 0.2–0.6×S where S is a thickness of a wall of workpiece.

12. Flow turning method according to claim 1, characterized in that the distance of the shaping tool from the mounting location of the pressure mandrel is 500 mm or more.

13. Flow turning method according to claim 1, wherein the shaping tool is mounted on the second end of the mandrel.

14. Flow turning method according to claim 1, wherein the shaping tool is mounted on a tailstock and provided adjacent the mandrel, the tailstock being mounted in the machine coaxially with the mandrel, wherein the workpiece is provided between the shaping tool and the mandrel.

* * * * *